US005685570A

United States Patent [19]

Gray et al.

[11] Patent Number: 5,685,570

[45] Date of Patent: Nov. 11, 1997

[54] POSTAGE STAMPS

[75] Inventors: Robert Gray, Mornington; John Caspers, Armadale; Ross McDougall, Blackburn South, all of Australia

[73] Assignees: Sprintpak Pty Ltd; Printset Cambec Pty Ltd., both of Victoria, Australia

[21] Appl. No.: 495,664

[22] PCT Filed: Apr. 6, 1993

[86] PCT No.: PCT/AU93/00148

§ 371 Date: Oct. 24, 1995

§ 102(e) Date: Oct. 24, 1995

[87] PCT Pub. No.: WO93/21620

PCT Pub. Date: Oct. 28, 1993

[30] Foreign Application Priority Data

Apr. 10, 1992 [AU] Australia ..... PL 1845

[51] Int. Cl.[6] ..... G09F 3/00

[52] U.S. Cl. ..... 283/71; 283/92; 283/93; 40/638

[58] Field of Search ..... 283/71, 85, 92, 283/93; 427/157, 210, 208.8, 208.4, 288, 265, 395, 411; 40/638; 428/690, 211, 254

[56] References Cited

U.S. PATENT DOCUMENTS

| | | | |
|---|---|---|---|
| 2,156,018 | 4/1939 | Humphner | 283/92 |
| 2,205,956 | 6/1940 | Humphner | 283/71 X |
| 2,250,197 | 7/1941 | Humphner | 283/71 X |
| 2,262,492 | 11/1941 | Farrell | 283/92 |
| 2,818,169 | 12/1957 | Bergstedt | 427/210 X |
| 3,136,424 | 6/1964 | Silverschotz | 283/71 X |
| 4,022,940 | 5/1977 | Schmelzer et al. | 427/288 X |
| 4,089,995 | 5/1978 | Ferro et al. | 427/157 |
| 4,533,244 | 8/1985 | Kaule et al. | 356/71 |
| 4,671,003 | 6/1987 | Vitol | 40/638 |
| 4,771,891 | 9/1988 | Sorensen et al. | 40/638 X |
| 4,876,000 | 10/1989 | Mikhail | 283/71 X |
| 4,895,747 | 1/1990 | Birkholz et al. | 283/71 X |
| 4,897,300 | 1/1990 | Boehm | 428/195 |
| 4,960,482 | 10/1990 | Crane et al. | 427/208.8 X |
| 4,978,145 | 12/1990 | Mikhail | 283/71 |
| 5,093,184 | 3/1992 | Edwards | 428/195 |
| 5,098,103 | 3/1992 | Mikhail | 283/71 |
| 5,149,139 | 9/1992 | Kaule | 283/92 X |
| 5,182,138 | 1/1993 | Matsuzawa et al. | 427/157 |
| 5,267,754 | 12/1993 | Kaule | 283/71 |
| 5,351,426 | 10/1994 | Voy et al. | 40/638 |

FOREIGN PATENT DOCUMENTS

| | | | |
|---|---|---|---|
| 558 468 | 9/1989 | Australia . | |
| 611625 | 5/1991 | Australia . | |
| 640 104 | 8/1993 | Australia | 40/638 |
| 0 342 982 | 11/1989 | European Pat. Off. | 283/85 |
| 0 449 291 | 10/1991 | European Pat. Off. . | |
| 1 232 503 | 1/1967 | Germany | 40/638 |
| 35 14 852 | 10/1986 | Germany | 283/71 |
| 39 21 636 | 1/1991 | Germany | 283/92 |
| 1 414 777 | 10/1975 | United Kingdom | 40/638 |
| 2182632 | 5/1987 | United Kingdom . | |
| 93 21 620 | 10/1993 | WIPO | 40/638 |
| WO 94 01 852 | 1/1994 | WIPO | 40/638 |

*Primary Examiner*—Daniel W. Howell
*Assistant Examiner*—Julie A. Krolikowski
*Attorney, Agent, or Firm*—Foley & Lardner

[57] ABSTRACT

A stamp (1) is disclosed which has a luminescent coating (9, 11) which over the area of the coating is such that there are a plurality of coated spaced regions interspersed with non-coated regions. The coating may be applied as a grid or cross hatching or other suitable arrangement. The coating is applied over an area which is of sufficient size relative to the thickness and density of the coating to permit the coating to be detected by a postage stamp luminescence detection device. The non-coated regions over which the coating extends being of sufficient area to permit penetration and drying of a stamp cancelling ink. A method of producing such stamp is also disclosed.

19 Claims, 2 Drawing Sheets

POSTAGE STAMPS

FIELD OF THE INVENTION

This invention relates to postage stamps.

DESCRIPTION OF PRIOR ART

Hitherto, postage stamps with a pressure-sensitive adhesive on a rear face have been known. An example of a stamp of this nature is disclosed in International patent Application No. PCT/AU91/00200 in the name of Australian Postal Corporation trading as Australia Post. This specification has been published under International No. WO 91/18378. The same stamp has been protected by way of Australian Petty Patent No, 611625. The subject matter of those patent specifications is imported herein by reference, Basically postage stamps with a pressure-sensitive adhesive are known by the general term peel and stick stamps as they are carried on a backing sheet and can be peeled therefrom and applied with the pressure-sensitive adhesive to a postal article. Some of the known postage stamps include a water-soluble layer between the rear face of the stamp and the pressure-sensitive adhesive. The water-soluble layer is provided to permit the stamp to be recovered from a postal article by soaking in water. The water thus penetrates the stamp and dissolves the water-soluble layer thereby enabling the stamp to be recovered from the postal article whilst leaving the pressure sensitive adhesive behind.

Stamps of the peel and stick type can be produced on a paper which itself does not have a luminescent coating such as a phosphor coating thereon or phosphor embedded therein. Thus, in order for such stamps to be detected by a luminescence detection means at a mail centre it has been necessary to coat the front surface of the stamp with luminescent material such as phosphor. In the past, this has been achieved by the use of a band of phosphor varnish printed across approximately one half of the stamp. The phosphor varnish, however, is both non-water penetrable and non cancelling ink penetrable. Therefore, two problems exist:- b 1. If a stamp is to be recovered from a postal article, water cannot penetrate the luminescent material coating and thus removal of the stamp is exceedingly difficult. 2. The approved post office security cancelling inks are unable to penetrate and dry on the luminescent coating.

It is not sufficient to merely reduce the area of the stamp cover by the luminescent material to enable water penetration as the problem is further complicated because with the known techniques of applying a luminescent material such as a phosphor varnish coating, the coating thickness is generally insufficient for luminescence detection if only a small area is applied to the stamp to enable subsequent recognition at the mail centre. Typically, the varnish is applied by a lithographic printing process and this results in a relatively thin coating applied to the stamp. Accordingly, it has been necessary to repeat the printing process several times to provide the necessary thickness and density of phosphor to enable satisfactory detection.

With known gum adhesive type postage stamps, the stamp material is itself suitably detection coated so that the approved post office security cancelling inks can penetrate the surface of the stamp and dry. Thus, for known gum adhesive type stamps there has not been a problem in relation to detection as the coating has been carefully chosen to have the required detection and cancelling ink penetration and drying properties. Such paper is quite expensive and in Australia, and some other countries, the suitable detection coated paper must be imported as stock for the stamp printers. Accordingly, stamp printers and postal authorities have desired to use a cheaper paper but there has been the problem of how to economically apply a suitable luminescent coating to the face of a stamp of such cheaper paper and at the same time permit the stamp to be detected by the known luminescence detection devices, and still be able to enable the known cancelling inks to penetrate the coating and to dry.

OBJECT AND STATEMENT OF INVENTION

Accordingly, it is an object of the present invention to attempt to overcome one or more of the aforementioned problems.

In accordance with a broad aspect of the present invention there is provided a postage stamp comprising a stamp material carrying a stamp image on a front face and an adhesive on the rear face, the front face having a luminescent coating which over the applied area comprises a plurality of coated spaced regions interspersed with non-coated regions, the applied area being of sufficient size relative to the thickness and density of the coating to permit the coating to be detected by a postage stamp detection device and the non-coated regions being of sufficient area to permit penetration and drying of a stamp cancelling ink.

In accordance with a further broad aspect of the present invention there is provided a method of producing a postage stamp to permit detection by a postage stamp luminescence detection device and to permit penetration and drying of stamp cancelling ink comprising:

(a) providing a stamp material;

(b) providing a stamp image to a front face thereof;

(c) providing an adhesive on the rear face;

(d) applying to the front face of the stamp a luminescent coating so that over the applied area there are a plurality of coated spaced regions interspersed with non-coated regions, the applied area being of sufficient size relative to the thickness and density of the coating to permit the coating to be detected by a postage stamp luminescence detection device, and the non-coated regions being of sufficient area to permit penetration and drying of stamp cancelling ink.

In accordance with a further broad aspect of the present invention there is provided a postage stamp of a stamp material with a stamp image carried on a front face thereof, and on the rear face a water-soluble coating and on the rear of the water-soluble coating a pressure-sensitive adhesive coating, the front face having a luminescent coating which over the area applied comprises a plurality of coated spaced regions interspersed with non-coated regions, the applied area being of sufficient size relative to the thickness and density of the coating to permit the coating to be detected by a postage stamp luminescence detection device and the non-coated regions being of sufficient area to permit penetration and drying of stamp cancelling ink and to subsequently allow water penetration for dissolving the water-soluble coating if the stamp is to be removed from a postal article.

In accordance with a further broad aspect of the present invention there may be provided a postage stamp as previously defined adhered to a release carrier backing by a pressure sensitive adhesive coating, so it can be released therefrom to be applied to a postal envelope by adhering thereto with the pressure sensitive adhesive coating.

In accordance with a further broad aspect of the present invention there may be provided a method of enabling a postage stamp to be detected by a postage stamp luminescence detection device, to permit penetration and drying of stamp cancelling ink, and to enable water penetration if the stamp is to be removed from a postal article comprising:

(a) providing a stamp material;

(b) providing a stamp image to said stamp material on a front face thereof;

(c) providing a water-soluble coating to the rear face of said stamp material;

(d) providing a pressure sensitive coating to the rear of the water-soluble adhesive coating;

(e) applying to the front face of the stamp a luminescent coating so that over the applied area there are a plurality of coated spaced regions interspersed with non-coated regions, the applied area being of sufficient size relative to the thickness and density of the coating to permit the coating to be detected by a postage stamp luminescence detection device, and the non-coated regions being of sufficient area to permit penetration and drying of stamp cancelling ink and to subsequently allow water-penetration for dissolving the water-soluble coating if the stamp is to be removed from a postal article.

Most preferably, the luminescent coating is applied as a phosphor varnish and it is preferable that it is applied as a stipple, thereby providing an arrangement of coated regions with interspersed non-coated regions. Alternatively it may comprise a fluorescent coating. Preferably, the stipple is applied as dots in a regular arrangement.

It is particularly preferred that the phosphor coating is applied by a letter press process.

BRIEF DESCRIPTION OF DRAWINGS

In order that the invention can be more clearly ascertained examples of preferred embodiments will now be described with reference to the accompanying drawings wherein.

DETAILED DESCRIPTION OF PREFERRED EMBODIMENTS

Figure 1:
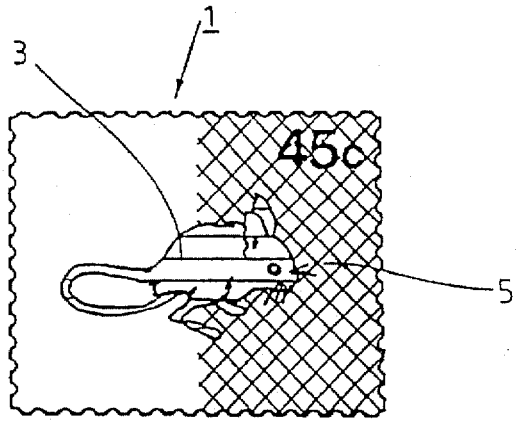
FIG. 1 is a front view of a conventional peel and stick postage stamp of the type described in the aforementioned patent applications.

Referring firstly to FIG. 1 there is shown a prior art peel and stick postage stamp of the type disclosed in the aforementioned International Patent Application No. PCT/AU91/00200. Here a stamp 1 is produced on a suitable stamp paper. The stamp 1 has a stamp image 3 on a front face thereof. The rear face of the stamp 1 is provided with a water-soluble coating and on the rear of the water soluble coating there is applied a pressure-sensitive adhesive coating. Typically, the stamp 1 is carried on a release backing (not shown) and can be peeled therefrom with the pressure sensitive adhesive intact on the rear of the stamp 1 so that the stamp 1 can be applied and adhered to a postal article by the pressure-sensitive adhesive. The peripheral edge of the stamp is suitably contoured, if required, to simulate perforations of a conventional perforated gum stamp. The aforementioned International Patent Application No. PCT/AU91/00200 makes particular reference to the contour of the peripheral edge of such stamp.

The front face of the stamp 1 has a detectable luminescent coating 5 in the form of a solid phosphor varnish which extends over a considerable surface area of the front face of the stamp 1. In the embodiments shown it extends across the height of the stamp and covers approximately a distance of about one half to one third of the length of the stamp. The luminescent coating has been applied by a lithographic press printing process using a suitable phosphor varnish as a printing medium.

Figure 2:
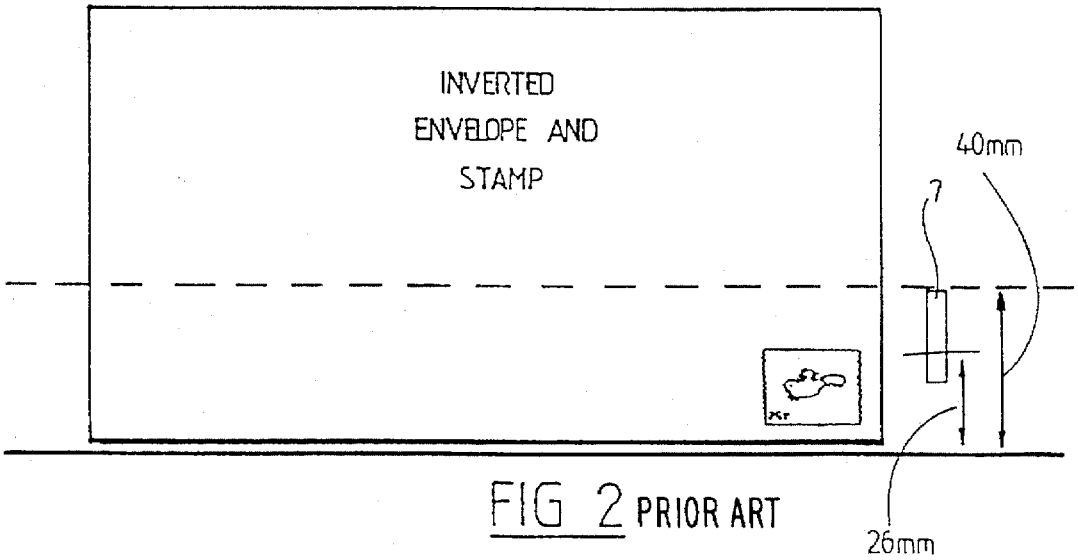
FIG 2 PRIOR ART
FIG. 2 is a diagrammatic view showing a prior art phosphor detection device used for detecting the presence of postage stamps on an envelope.

In use, an envelope with a stamp thereon is received at a mail centre and delivered to a known device for detecting the presence of a genuine stamp and for cancelling that stamp. The device is arranged to receive the envelopes in an inverted form as shown in FIG. 2. A luminescence detection window 7 of approximately 23 mm in height is spaced so that the uppermost edge is 40 mm from the base of the device and so that the approximate centre of the window 7 is about 26 mm from the base. The window, in turn, overlaps the position of a stamp as an envelope and stamp are moved therepast.

In order to provide for satisfactory detection by the detection device, it has been necessary to apply the phosphor varnish coating over a substantial portion of the area of the stamp face as disclosed in FIG. 1.

Several problems have occurred in relation to stamps with a phosphor coating 5 which extends over this relatively large area of the stamp. Firstly, philatelists who wish to recover used stamps from a postal article, have been unable to readily recover the stamp as the water-soluble adhesive or layer has not been able to be wetted in the region where the phosphor varnish coating 5 is applied. This is because the phosphor varnish coating is generally water-impervious. In addition, water is unable to reach the water-soluble adhesive or coating from the undersurface of the envelope as the pressure-sensitive adhesive provides a further barrier. Thus, the stamp can be permanently disfigured during the recovery from a postal article. Thus, philatelists find it difficult to accept peel and stick stamps of this type. Secondly, the coating 5 is such that it does not permit penetration and drying of the approved stamp cancelling inks. Thus, it has been difficult to correctly and reliably cancel stamps of this nature.

Figure 3:
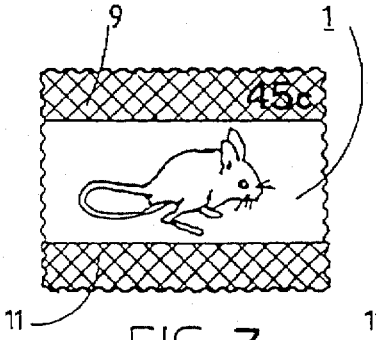
FIG 3 through 5 are front views of examples of postage stamps produced in accordance with the present invention.

Referring now to FIG. 3 there is shown an example of one preferred embodiment of the present invention. Here, the postage stamp 1 is of the same peel and stick type as shown in the embodiment of FIG. 1. Thus, it is produced generally in accordance with the disclosures in the aforementioned International Patent Application No. PCT/AU91/00200.

The front face of the stamp 1 is covered with a luminescent coating preferably a phosphor varnish coating over selected regions 9 and 11. In the embodiment shown in FIG. 3 the selected regions comprise an upper horizontal region 9 and a lower horizontal region 11 which extend the length of the stamp. The coatings in the regions 9 and 11, over the area of the applied phosphor varnish are such that there a plurality of coated spaced regions interspersed with non-coated regions. It is particularly preferred that the coating be applied as a stipple which will provide a plurality of coated spaced regions interspersed with non-coated regions.

Other arrangements for coating which provide for a plurality of coated spaced regions interspersed with non-coated regions may comprise applying the phosphor coating in a grid arrangement or a cross-hatched arrangement. Any arrangement would appear to be satisfactory provided there are a plurality of coated spaced regions interspersed with non-coated regions. In the case where the coated regions are provided by a stipple coating, the percentage area of the stipple can be varied to suit the thickness and density of the phosphor of the coating which is applied. In other words, the coating must present a sufficient surface area for the density of the coating, to be detected by the window 7 in the luminescence detection device. In the case where the coating is applied by a sheet-fed letterpress, the coating will typically be in the order of about 7.5 microns thickness. Thus, in this case, each of the regions 9 and 11 can have an approximate 80% cover of stipple varnish coating of a composition to be described. The remaining approximate 20% being uncoated. Thus, in the example shown in FIG. 3 where the height of each of the regions 9 and 11 is in the order of 4 mm, and applied over a generally white background, an approximate 80% cover of a suitable stipple phosphor varnish applied by a sheet-fed letterpress will give satisfactory detection results. Other percentage areas may be entirely satisfactory. For example, in order to determine a satisfactory percentage area cover it is necessary to conduct some experimentation having regard to the thickness and density of the coating applied, the spacing or percentage cover of the varnish applied and the reflective qualities of the surface over which the varnish is applied and, finally the transverse length of the exposed surface of the coating which is presented across the length of the window 7, i.e. the width of the regions 9 and 11 from top to bottom of the stamp. In practice, a balance must be achieved between the surface area of the stipple—providing the plurality of coated spaced regions interspersed with non-coated regions—to achieve the required detection whilst, at the same time, permitting penetration and drying of an approved cancelling ink, over the regions 9 and 11, and water penetration which may be required when the stamp is to be released from a postal article. Thus, the permeations of thickness and density of phosphor, cross-sectional area available, reflectivity of the surface of the stamp 1 and the exposed length of the phosphor coating to the detection window 7 need be considered.

Figure 4:
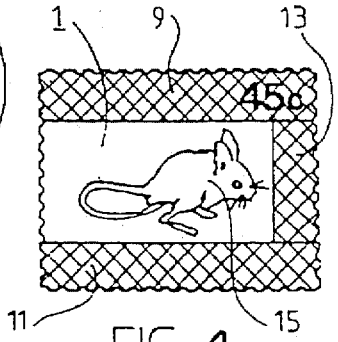

Referring now to FIG. 4 there is shown an embodiment of a further preferred stamp similar to that in FIG. 3 where in addition to providing the coating over regions 9 and 11 a coating band is applied over region 13 at one end of the stamp. Thus, a greater length of the coating can be provided across the detection window 7.

Figure 5:
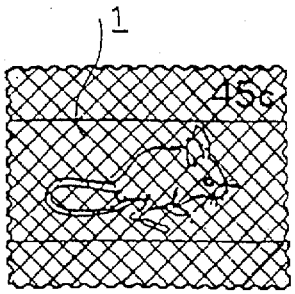

In FIG. 5 there is shown a stamp 1 similar to that in the previous embodiments except that the coating is applied over the whole of the surface area of the stamp 1.

In an embodiment not shown, the coating may be applied over selected regions such as the regions shown or, alternatively over discrete portions of the stamp image such as on the animal 15 shown in FIG. 4. Thus, in future, stamps may need to be designed carefully to take into account the image on the stamp and the coating regions.

Thus, in all cases, the coating is applied over an area of the stamp to provide a plurality of coated spaced regions interspersed with non-coated regions and where over the applied area the coated regions are of sufficient size relative to the thickness and density of the coating to permit the coating to be detected by a postage stamp luminescence detection means, and the non-coated regions being of sufficient area to permit adhered application of stamp cancelling ink and to subsequently allow water penetration for dissolving the water-soluble coating if the stamp is to be removed from a postal article.

Figure 6:
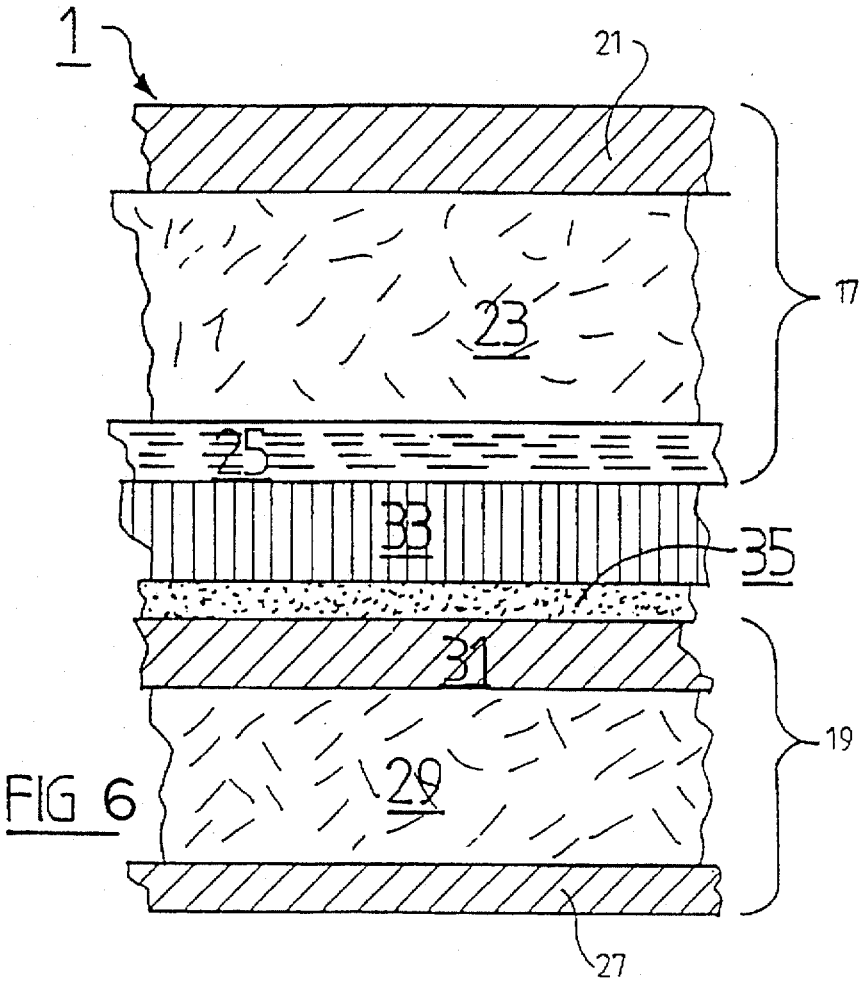
FIG. 6 is a cross-sectional view taken through a stamp according to the present invention.

Preferably, the phosphor varnish coating for the embodiments above is formulated in accordance with the following formula:

- 2 parts matt varnish—supplied by Collie Cook Consolidated of Gracie Street, North Melbourne, Victoria, Australia
- 1 part HELECON 336, phosphor—supplied by Chemical and Petroleum Industries of 20 Ponting Street, Williamstown, Victoria, Australia Referring now to FIG. 6 there is shown a transverse cross-section taken through a preferred postage stamp embodying the present invention. Here it can be seen that the stamp 1 is produced by two substrates 17 and 19. Substrate 17 is preferably of a coated paper of 80 gsm such as Redan manufactured by Australian Pulp & Paper Mills, Marine Terrace, Burrile, Tasmania, Australia. It comprises an upper clay coating 21, a base paper 23, a water-soluble layer 25. The substrate 19 is suitable backing material such as siliconized backing of any suitable material. Suitable substrates 19 are glassinc, kraft and coated backing papers. Suitable materials can be supplied by Consolidate Paper Industries, Mills Road, Braeside, 3195, Victoria, Australia and Jac Australia Pty Ltd of 663 Chapel Street, South Yarra, 3141, Victoria, Australia. Substrate weight is preferably in the range 90–100 gsm. It comprises a lower clay coating 27 with a base paper 29, with an upper clay coating 31. Thus, the substrate 19 comprises a carrier backing whilst substrate 17 comprises the stamp 1. Applied to the undersurface or back of the water-soluble layer 25 is a conventional pressure-sensitive adhesive 33. A silicon coating 35 is applied over the clay coating 31 and thus, the stamp 1 with the pressure-sensitive adhesive 33 can be releasably bonded to the substrate 19 on the silicon coating 35 thereon.

Figure 7:
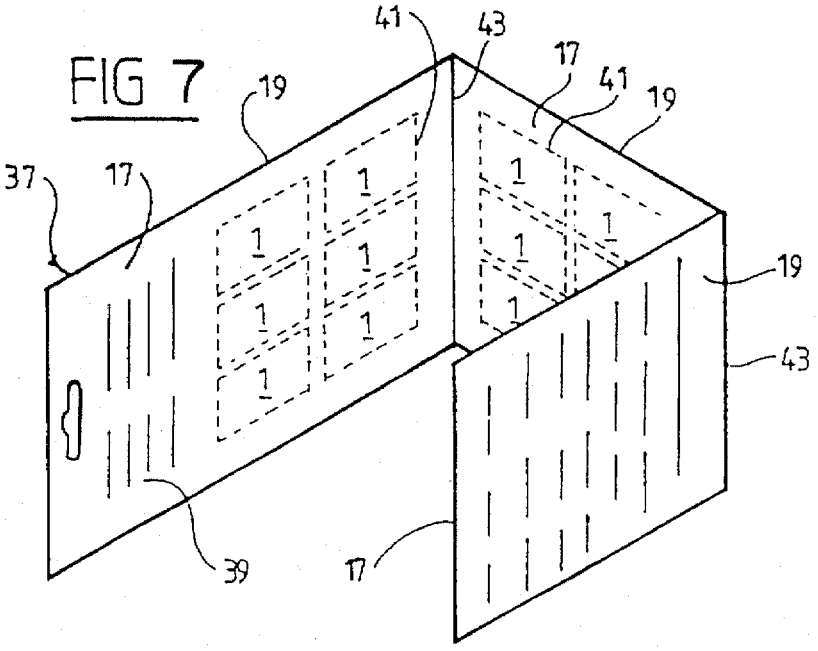
FIG. 7 is a perspective view showing a booklet incorporating the preferred postage stamps.

Referring now to FIG. 7 there is shown how a booklet of postage stamps can be produced. Here, stamp material 37 as described in relation to FIG. 6 is printed with a plurality of stamps 1 on one face. The stamps will have the luminescent coating applied thereto in the required arrangement so that each stamp 1 can be detected by a luminescence detection apparatus. The stamps are severed by score lines 41 through the substrate 17 and the pressure-sensitive adhesive 33 but not through the silicon coating 35 or substrate 19. Thus, individual stamps 1 can be peeled from the material 37 intact with the pressure-sensitive adhesive on the rear face so they can be adhered to a postal article. The material 37 is printed on the rear face—on the exposed face of the substrate 19—with any required markings. The material 37 can be folded along fold lines 43 to form a suitable booklet which can be easily carried, thus, presenting the stamps 1 in a booklet form which results in a convenient means of selling stamps.

The inventive process of luminescent coating is equally applicable to conventional gum stamps to permit:

1. detection by luminescence detection devices;
2. the penetration and drying of approved stamp cancelling ink and thus the invention is to be considered to clearly extend to such stamps. By using the luminescent coating as outlined herein less expensive papers can now be used as the stamp paper.

Instead of the luminescent coating being a phosphor coating, it may be a fluorescent coating material, such as a coating material similar to that currently used by the Canadian Postal Authorities and which is applied in solid areas and not in the arrangement contemplated in this invention.

Modifications may be made to the present invention as would be apparent to persons skilled in the stamp arts and/or printing arts and these are considered to be within the ambit of the invention the nature of which is to be determined from the foregoing description.

We claim:

1. A postage stamp comprising a stamp substrate which is finish coated on a front face and having a stamp image on said front face applied over the finish coating, an adhesive on a rear face, there being a luminescent coating printed over the front face of the stamp over the finish coating over one or more areas which may include and be on said stamp image, said luminescent coating comprising a plurality of coated spaced regions interspersed with non-coated regions, the luminescent coating being of sufficient collective area relative to its thickness and density to permit it to be detected by a postage stamp luminescence detection device and the non-coated regions being of sufficient area and distribution relative to the coated regions to permit penetration and drying of a stamp cancelling ink of a cancelling stamp and subsequent recognition of the cancelling stamp image as a substantial whole if applied over said one or more areas.

2. A postage stamp as claimed in claim 1 wherein the luminescent coating is applied along the length of the stamp.

3. A postage stamp as claimed in claim 2 wherein the luminescent coating is applied to a top of the stamp.

4. A postage stamp as claimed in claim 2 wherein the luminescent coating is applied to a bottom of the stamp.

5. A postage stamp as claimed in claim 2 wherein the luminescent coating is applied to a top and to a bottom of the stamp.

6. A postage stamp as claimed in claim 1 wherein the luminescent coating is applied along the width of the stamp.

7. A postage stamp as claimed in claim 6 wherein the luminescent coating is applied to a left hand side of the stamp.

8. A postage stamp as claimed in claim 6 wherein the luminescent coating is applied to a right hand side of the stamp.

9. A postage stamp as claimed in claim 7 wherein the luminescent coating is applied to a left hand side and to a right hand side of the stamp.

10. A postage stamp as claimed in claim 1 wherein the luminescent coating is applied in an area which extends over the whole of the front face of the stamp and over said stamp image.

11. A postage stamp as claimed in claim 1 wherein the luminescent coating extends over a selected region of the stamp image.

12. A postage stamp as claimed in claim 1 wherein the luminescent coating is applied as a phosphor varnish coating and wherein over the one or more areas there is approximately 80% of coating and approximately 20% non coating over a white background.

13. A stamp as claimed in claim 1 wherein the luminescent coating is applied as a stipple coating.

14. A stamp as claimed in claim 1 wherein the adhesive is a pressure-sensitive adhesive.

15. A stamp as claimed in claim 14 wherein the pressure-sensitive adhesive is adhered to a release carrier backing so the stamp can be released from said release carrier backing to be applied to a postal article.

16. A stamp as claimed in claim 14 wherein there is a water-soluble layer between the stamp material and the pressure sensitive adhesive to permit the stamp to be recovered from a postal article by water dissolving of the water-soluble layer by water penetration in areas which are not coated with a luminescent coating.

17. A method or producing a postage stamp to permit detection by a postage stamp luminescence detection device and to permit penetration and drying of stamp cancelling ink comprising:

(a) providing a stamp substrate which is finish coated on a front face;

(b) providing a stamp image to said front face over the finish coating;

(c) providing an adhesive on the rear face;

(d) applying to the front face of the stamp, after the stamp image is applied thereto, a luminescent coating over one or more areas which may include and be on said stamp image so there are a plurality of coated spaced regions interspersed with non-coated regions, the luminescent coating being of sufficient collective area relative to its thickness and density to permit it to be detected by a postage stamp luminescence detection device, and the non-coated regions being of sufficient area and distribution to permit penetration and drying of stamp cancelling ink of a cancelling stamp and subsequent recognition of substantially the whole of the cancelling stamp image if applied over said one or more areas.

18. A method as claimed in claim 17 further comprising the step of applying the luminescent coating as a stipple.

19. A method as claimed in claim 18 wherein the stipple is applied as a series of dots in a regular arrangement.

* * * * *